United States Patent [19]

Babitzka et al.

[11] 4,388,908

[45] Jun. 21, 1983

[54] ELECTRICALLY CONTROLLED VALVE OPERATING SYSTEM, PARTICULARLY FOR FUEL INJECTION

[75] Inventors: Rudolf Babitzka, Kirchberg; Walter Beck; Walter Schlagmüller, both of Schwieberdingen, all of Fed. Rep. of Germany

[73] Assignee: Robert Bosch GmbH, Stuttgart, Fed. Rep. of Germany

[21] Appl. No.: 311,676

[22] Filed: Oct. 15, 1981

[30] Foreign Application Priority Data

Oct. 23, 1980 [DE] Fed. Rep. of Germany ..... 3039967

[51] Int. Cl.[3] ..... F02D 1/16; F02M 37/04

[52] U.S. Cl. ..... 123/500; 123/446

[58] Field of Search ..... 123/446, 447, 500, 458, 123/459

[56] References Cited

U.S. PATENT DOCUMENTS

| | | | |
|---|---|---|---|
| 1,644,769 | 10/1927 | Banner | 123/500 |
| 2,287,702 | 6/1942 | Nichols | 123/446 |
| 3,851,635 | 12/1974 | Murtin et al. | 123/458 |

FOREIGN PATENT DOCUMENTS

| | | | |
|---|---|---|---|
| WO81/00283 | 2/1981 | PCT Int'l Appl. | 123/500 |

*Primary Examiner*—Ira S. Lazarus
*Assistant Examiner*—Magdalen Moy
*Attorney, Agent, or Firm*—Frishauf, Holtz, Goodman & Woodward

[57] ABSTRACT

To provide for extremely rapid operating conditions of the valve in an electrically controlled fuel injection system, that is, valve operation in the order of $10^{-5}$ seconds, for example, a pump (2, 62) provides pressurized fuel, and two, in push-pull operating valves (4, 64; 5, 65) are provided, in which one of the valves (4, 64) controls initiation of fuel injection, and the other one of the valves (5, 65) controls termination thereof; each one of the valves uses a spring-loaded valve element (18, 38'', 38, 38'), operated by the pressure of the fuel to be injected, the valve elements being retained in a predetermined position by an electrically controlled operating unit (27, 47''; 47, 47') which has a positioning element operating in a positioning path having at least a component which is perpendicular to the operating direction of the valve element and which, as commanded by the control voltage applied thereto, clamps the valve element in a predetermined position, and thus prevents movement of the valve element even though fluid pressure is applied thereto. Preferably, the electrical control element is a stack of piezoelectric disks which, upon energizaton, expand in axial direction and press a clamping stem (26, 46''; 46, 46') the movable valve element (18, 38'', 38, 38') in an operating bore of the valve unit or housing (16, 36).

14 Claims, 12 Drawing Figures

ELECTRICALLY CONTROLLED VALVE OPERATING SYSTEM, PARTICULARLY FOR FUEL INJECTION

Cross reference to related applications, assigned to the assignee of the present application:

U.S. Ser. No. 274,526, filed June 17, 1981, Babitzka et al.;

U.S. Ser. No. 311,678, filed Oct. 15, 1982, Babitzka et al. (claiming priority No. P 30 39 915.6);

U.S. Ser. No. 311,677, filed Oct. 15, 1982, Babitzka et al. (claiming priority No. P 30 39 973.6).

The present invention relates to a valve operating system, and more particularly to a system to control a fuel injection valve to supply fuel to an internal combustion engine, for example to a Diesel engine.

BACKGROUND

It is frequently desirable to provide a valve system in which the opening time of the valve is extremely short; in other words, a graph of opening of the valve vs. time should have as steep a flank as possible. In specially constructed fuel injection systems, switching times between open and closed positions of the valve of $10^{-3}$ seconds have been obtained. These switching times, that is, the flanks of the graphs of valve opening vs. time, still are not steep enough. Electronically controlled fuel injection requires extremely accurate ON and OFF control and, therefore, an even faster operating speed of the valve is desirable.

THE INVENTION

It is an object to provide a valve system in which both the ON and the OFF valve operation permitting, for example, injection of fuel to an internal combustion engine, typically of the Diesel type, can be accurately controlled.

Briefly, the system includes a pump which supplies the fluid to be controlled to an injection element, such as an injection nozzle. An electrical control system provides pulses which control the ON and OFF time of the valve system.

In accordance with the invention, two valves are provided, operating in push-pull operation, that is, one valve controls initiation of injection, and the other valve controls the termination of injection; these valves may be termed the ON valve and OFF valve, respectively. Each one of the valves has a spring-loaded valve element which controls the flow of fluid; the position of the spring-loaded element is controlled by an electrical positioning element which has a movement such that at least one component thereof extends at right angles to the operating movement of the valve element, and which is positioned with respect to the valve element to clamp it in a respective position.

In accordance with a feature of the invention, the clamping element is an assembly of stacked piezoelectric disks in which the axis of the disks is, preferably, at least approximately perpendicular to the operating movement of the valve element. Using piezoelectric elements permits extremely rapid operating times, in the order of $10^{-5}$ seconds, for example. The assembly made up of the stack of piezoelectric disks reacts almost instantaneously to electrical impulses, and provides an expansion of contracting force which is very high—although the expansion or contraction distance of the respective disks themselves is very small. Positioning the stack of disks to be at least approximately transverse to the operation of the valve element—which is, itself, operated by externally generated forces, such as hydraulic pressure, a spring, or the like, permits application of very high clamping forces on the valve element, with effectively instantaneous release of the clamping forces and hence movement of the valve element, while requiring only a minimum of travel of the clamping element, that is, excursion of the piezoelectric disks.

DRAWINGS

Two embodiments of the invention are illustrated, the first embodiment including FIGS. 1–8, and the second embodiment FIGS. 9–12.

Figure 1:
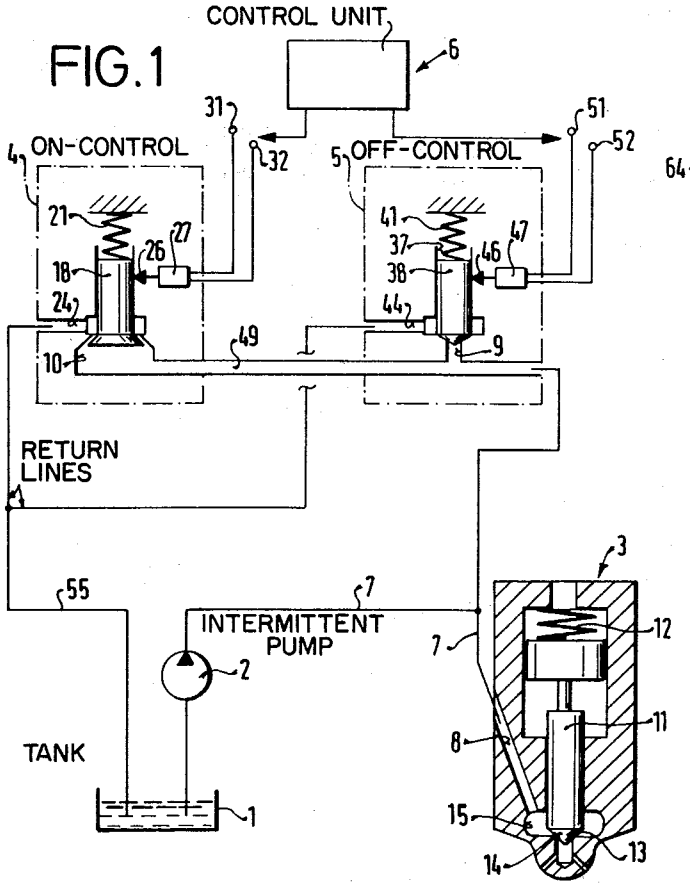
FIG. 1 is a general, highly schematic system diagram of a fuel injection system for an internal combustion engine, for example for a Diesel engine.

FIG. 1 is a highly schematic representation of a fuel injection system for a Diesel engine, although a similar system could be used for an Otto-type engine. The system has, basically, five major components: A fuel tank 1, a fuel pump 2 which, for example, may be a piston pump and thus intermittently operating, that is, providing intermittent pumping pressure, a fuel injection valve, a valve system having an ON-control valve 4 and an OFF-control valve 5, and an electronic control unit 6 which provides control pulses to the valves 4 and 5 in accordance with a program, for example timing pulses derived, after suitable processing, for injection delays and injection duration, from a transducer coupled to the crankshaft of the engine, which is not shown.

Pump 2 has its suction terminal connected to the tank 1 to suck fuel from the tank 1 and to provide it through a supply line 7 to the fuel injection valve 3 and to the valves 4, 5, respectively. The supply line 7, receiving pressurized fuel, is connected to the supply connection or bore 8 of the injection valve 3. The supply line 7 is additionally connected to a branch flow line 49 which, in turn, is connected to the inputs 9, 10 of the valves 4, 5.

The fuel injection valve 3 atomizes and distributes the fuel within the combustion chamber of the engine. The injection valve 3 comprises a fluid-controlled needle valve which has a valve needle element 11 pressed by a spring 12 on the matching valve seat 13. A ring-formed chamber 15 is positioned above the injection nozzles 14, in fluid communication with the fluid inlet bore 8, as shown schematically in FIG. 1. The needle element 11 is normally held in closed position by a spring 12, and lifted off closed position, permitting injection of fuel through bore 8 and ring space 15 into the valve nozzle 14 when the pressure within the chamber 15 exceeds the force of the spring 12.

Figure 2:
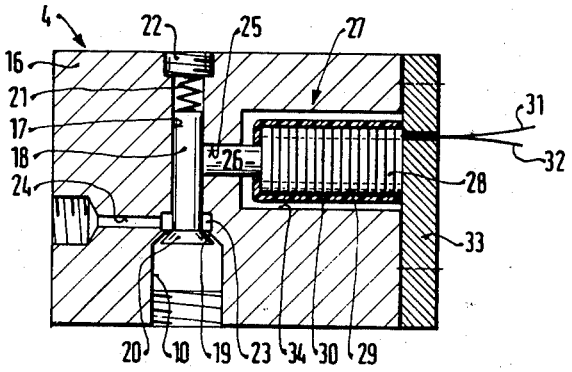
FIG. 2 is a schematic transverse sectional view through the ON valve of the system.

Referring now to FIG. 2 which shows the ON-valve 4 in greater detail: A housing 16 has a valve bore 17 therein. A piston-like valve element 18 is located in the bore 17 to be slidable therein while being sealed within the bore.

The input or inlet 10 to the valve is formed by a bore which has a substantially larger diameter than bore 17 and which is coaxial thereto. A cone-shaped valve seat 19 is formed at the transition between the inlet bore 10 and the valve bore 17. A conical valve sealing surface 20 cooperates with the conical seat 19, the sealing surface 20 being located on an expanded terminal portion of the valve element 18, extending outwardly in generally mushroom-like shape. A pressure spring 21 is located within the valve bore 17 which bears, on the one hand, on the end portion of the valve stem 18 and, on the other, on a sealing plug 22 screwed into the valve body 16 and closing off the bore 17. The spring 21 is strong enough to hold the valve in the open position, as illustrated in FIG. 2, with the sealing surface 20 lifted off the seat 19.

A ring-shaped chamber 23, coaxial to the valve bore 17, is formed in the interior of the valve body, adjacent the seating surface 19, and at the side remote from the inlet 10. The ring chamber 23 terminates in an outlet connection duct 24.

The valve stem 18 is slidable in the bore 17. A guide bore 25 extends transversely to the bore 17, that is, transversely to the movement of the valve element 18. A clamping stem 26 is slidable within the guide bore 25. The clamping stem 26 is a portion of the electrically controllable positioning element 27.

The positioning element 27 is built up in form of a stacked array 28 of piezoelectric disks 29, positioned with an insulating housing 30. The piezoelectric disks 29 are connected, electrically, in parallel and can have an electrical direct current voltage applied thereto by energization of supply lines 31, 32. The stacked array 28 is secured to a cover 33 which closes off a blind bore 34 formed in the housing or valve block 16. The guide bore 25, within which the clamping stem 26 is slidable, terminates in the blind bore 34. (See also the cross-referenced applications).

When the piezoelectric disks 29 are deenergized, the clamping stem 26 will be spaced from the outer circumference of the valve element 18. The spacing is extremely small—a few thousandths of a millimeter, for example, Preferably, the end surface of the clamping stem 26 is slightly concave.

Operation of the valve 4: Upon applying a direct voltage to the terminals 31, 32, the piezoelectric disks 29 will expand under the influence of the applied electric field and, simultaneously, contract in their diameter. The expansion will be in the direction of the axis of the stacked array, shifting the clamping stem 26 in the direction towards the valve stem 18. The valve stem 18 is thus engaged by the clamping stem 26 and pressed against the opposite side or wall of the valve bore 18. The piezoelectric force is extremely high, and the high clamping force can hold the valve stem 18 securely against the opposite wall of the bore 17 to reliably prevent any shifting movement of the valve element 18 and with it the mushroomed-out valve seat and sealing element 20.

FIG. 2 illustrates the position in which the piezoelectric elements 29 are energized, that is, the supply lines 31, 32 have a direct voltage applied thereto, thus clamping the valve element in the position removed from the sealing surface 19. Pressurized fluid flowing from the inlet 10 to the outlet 24 will cause some pressure to build up at the throttle which is formed by the small gap between the sealing surface 20 and the valve seat 19. This pressure has the tendency to close the valve. Upon deenergization of the electric connection lines 31, 32, the sealing surface 20 of the valve element 18 is pushed against the seat 19 by the pressure build-up. The arrangement is so made that the control voltage is turned off only when the full throttle pressure P4 (FIG. 7) has been reached, as will appear in more detail below.

Figure 3:
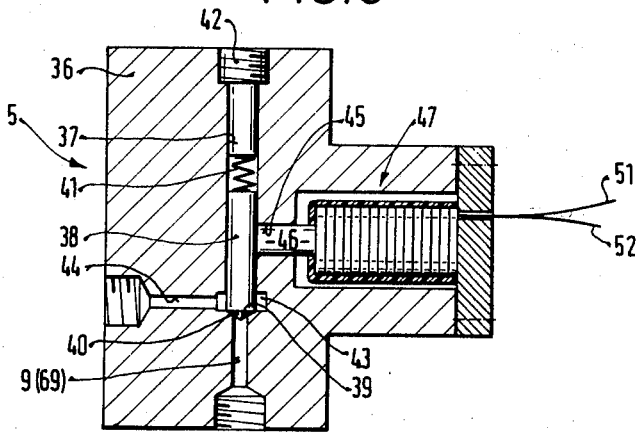
FIG. 3 is a schematic transverse sectional view through the OFF valve of the system.

Referring to FIG. 3, the OFF valve 5: Valve 5 is controlled by electrical supply connections 51, 52, and is located within a housing 36 having a valve bore 37. The valve bore 37 retains a piston-like valve element 38 therein, slidable in the bore but sealed with respect thereto. The valve element 38 has a conical sealing surface 40, which cooperates with the corresponding hollow-conical formed seating surface 39. The seating surface 39 is formed in the transition between the inlet connection 9 and the valve bore 38. In the valve of FIG. 3, the valve bore 38 has a larger diameter than the inlet connection line 9. A ring-shaped chamber 43 is positioned immediately adjacent the seating surface 39, coaxial to the bore 37, and terminating in an outlet bore 44.

A pressure spring 41 engages the upper part of the valve stem 38, and is supported at its upper end by a plug 42, screwed into the housing 36. The housing 36 may be of any random shape; as shown in FIG. 3, it has an upwardly extending portion and, in order to keep the spring 41 to a reasonable size, the plug 42 has a projecting stem.

A bore 45 extends at right angles to the bore 37, approximately in the center of the axial length of the valve element 38, similar to the bore 25 (FIG. 2) which, also, preferably is positioned about midway between the ends of the stem 18. A clamping stem 46 is slidable in a guide bore 45 and form part of an electrically controllable positioning element 47 which is similar to, and preferably identical to the positioning element 27 of FIG. 2, and energized over connecting lines 51, 52.

Referring again to FIG. 1: The outlets 24, 44 of the valves 4, 5 are connected to a return line 55 which is returned to the tank 1.

The electrical control lines 31, 32 and 51, 52 of the valves 4, 5, respectively, are connected to control unit 6. In operation of a fuel injection system, the electrical control unit provides control voltages which have a timing and pulse duration dependent on engine operating and command parameters, for example depending on induction pipe pressure, engine speed, temperature, or other correction values. The control parameters are sensed by suitable transducers positioned on the engine, and converting the respective sensed values into electrical signals which are applied to the control unit, as well known in the combustion engine control field. Transducers may, for example, be injection triggering sensors coupled to an ignition distributor in an Otto engine, pressure sensors, temperature sensors, exhaust gas composition sensors, engine speed control transducers, and the like.

Figure 4:
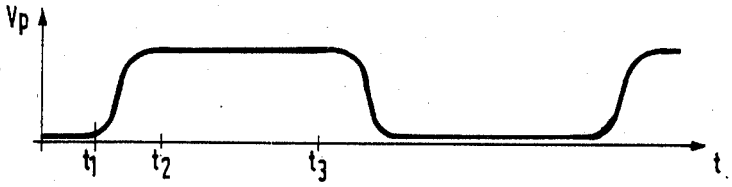
FIG. 4 shows the time-vs.-volume diagram of fluid flow.

Operation, with reference to FIGS. 1 and 4–8: Let it be assumed that the system of FIG. 1 is designed to control injection of fuel for a Diesel engine, and pump 2 is a typical Diesel engine piston pump. The volumetric flow of fuel from a typical Diesel engine piston pump, with respect to time, is shown in FIG. 4. The subsequent FIGS. 5 through 8 are drawn in vertical alignment with FIG. 4, and the abscissa, in each instance, is a time axis.

Figure 5:
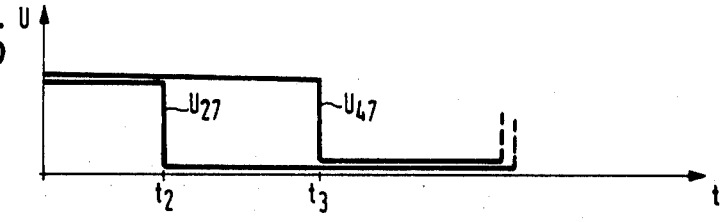
FIG. 5 shows the control voltages for control of the valves of FIGS. 2 and 3, respectively.
Figure 6:
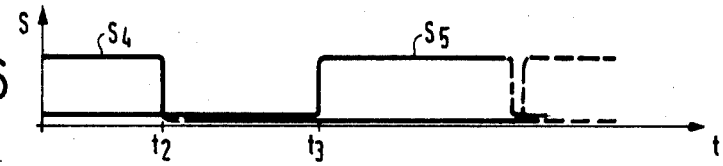
FIG. 6 shows the excursion-vs.-time diagram of the valves of the system.
Figure 7:
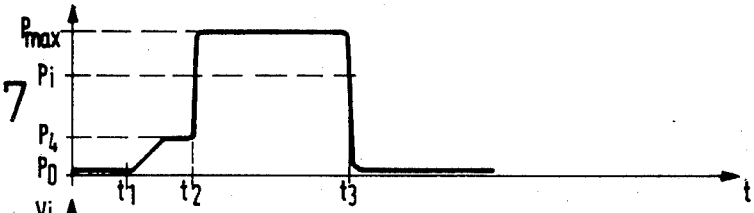
FIG. 7 shows the pressure-vs.-time diagram in the system.

At time $t_1$, the volume of the flow supplied by the pump 2 begins to rise. The valve elements 18, 38 of the valves 4, 5 are in the position shown in which, as seen in FIG. 5, a control voltage is applied to the positioning elements 27, 47, respectively. The valve element 18 of the valve 4 is in its maximum deflected position—see curve $s_4$, FIG. 6. The valve element 38 of valve 5 is on its seat, that is, it is closed, see curve $s_5$, FIG. 6, corresponding to undeflected position, that is, at stroke zero. As seen in FIG. 7, the line 49 will have a pressure in the time before $t_1$ of approximately zero, that is, $P_0$. At the time $t_1$, fluid will begin to flow and pressure will build up on the throttle formed between the sealing surface 20 and the seat 19 in the valve 4. This pressure is shown as $P_4$ and will also be the pressure within the flow line 49, and in the ring chamber 15 of the injection valve 3.

The control unit 6 commands fuel to be injected at the time instant $t_2$. At this time, the voltage $U_{27}$ applied to the connecting lines 31, 32 of the ON-control 4 is disconnected. This relieves the clamped-open position of the stem 18 and the pressure $P_4$ within the cross-connecting flow line 49 rapidly closes the valve 18, moving it in its closed position—see curve $s_4$, FIG. 6. Consequently, the flow line 49 is closed, and communication to the return line 55 to the tank is cut off. Pressure rises extremely rapidly—see FIG. 7. The switching time of the valve 4 is in the order of $10^{-5}$ seconds. The flank of pressure rate at time $t_2$, thus, is practically vertical, up to the maximum pressure $P_{max}$. This maximum pressure $P_{max}$ is above the opening pressure $P_i$ of the fuel injection valve, which lifts the valve needle 11 (FIG. 1) of the injection valve 3 off its seat 13 and causes injection of the fuel into the combustion chamber of the engine.

Figure 8:
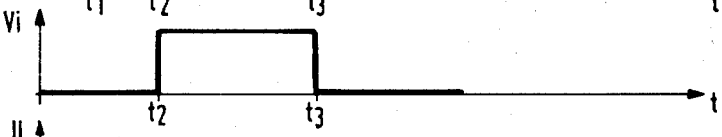
FIG. 8 shows the injection volume with respect to time as injected by a fuel injection nozzle.
Figure 10:
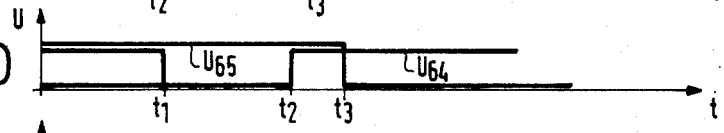
FIG. 10 shows the control voltages for the system of FIG. 9.
Figure 11:
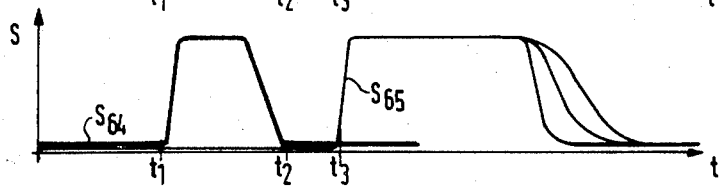
FIG. 11 shows the excursion-vs.-time diagram of the valves of FIG. 9.
Figure 12:
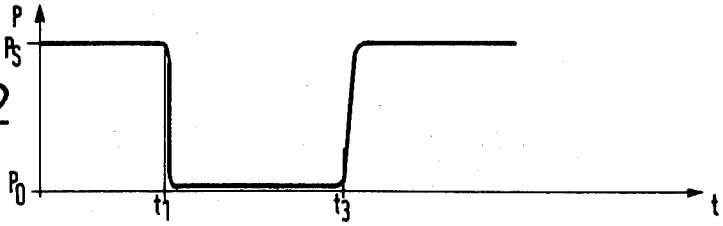
FIG. 12 the control pressure-vs.-time diagram of the system of FIG. 9.

In accordance with timing controlled by the electronic control unit 6, which determines the injection period, the fuel injection is to terminate at time $t_3$ (FIGS. 4–8). At this time, the control voltage applied to the connecting lines 51, 52 of valve 5 is terminated—see drop in control voltage $U_{47}$, FIG. 5. The pressure in line 49 acting at the input 9 of valve 5, and hence on the valve element 38 thereof, lifts the valve element 38 off the seat 39—see curve $s_5$, FIG. 6. This provides communication between the pressurized line 7 and the connecting flow line 49, and thus to the ring chamber 15 of the injection 3, and effectively connects the ring chamber 15 of the injection valve 3 with the return line 55 to the tank 1. Pressure, thus, drops at the time instant $t_3$ to the null pressure $P_0$—see FIG. 7. The injection valve closes by action of the spring 12. The volume of fluid, that is, combustion fuel as shown in FIG. 8, has been passed through the valve system. When the piston of the injection pump 2 has reached its top dead center (TDC) position, the volume of fuel within the cylinder of the pump 2 has been ejected, partly into the engine through valve 3, partly returned to the tank. The cycle will then repeat.

It is, of course, entirely possible to construct pump 2 as continuously operating pump, or to supply fluid through line 7 from a pressurized storage vessel.

Figure 9:
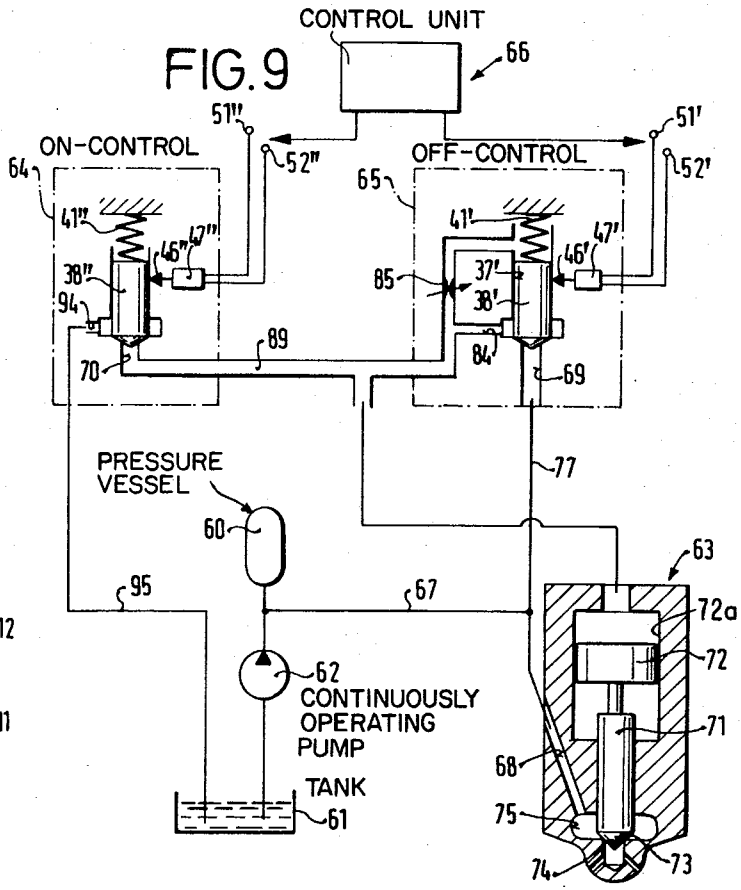
FIG. 9 shows a system diagram of the second embodiment.

Embodiment of FIG. 9: Pump 62 is a continuously operating pump, the embodiment of FIG. 9 being arranged as a fuel injection system for an internal combustion engine. The basic system has a fuel tank 61, the continuously operating pump 62, an injection nozzle 63, two valve units 64, 65, and an electronic control unit 66. Pump 62 provides fuel taken from a tank 61 to a pressurized storage tank 60. Tank 60 is connected to a supply line 67 which is connected to inlet line 68 of the injection valve 63 and to the input 69 of the valve 65.

The injection valve 63 is a liquid controlled needle valve having a valve needle 71 which is maintained in closed position by a control pressure acting on a piston 72 coupled to the valve stem 71, and retaining the piston 72 on the valve seat 73. A ring chamber 75 is located above the injection valve nozzle 74, with which the connection line 68 communicates. The valve needle 71 is lifted off its seat by pressure in the chamber 75 when the control pressure acting on the piston 72 drops below that of the pressure in chamber 75 and acts on the needle valve as determined by the pressure in the respective line 67, 77 and in line 89, as will be described in detail below.

The control valve 64 forming the ON-control element of the system corresponds to the valve 5 illustrated in FIG. 3, the forms the OFF-control unit in the system of FIG. 1. The control unit 65, except for some modifications to be described, corresponds to the valve illustrated in FIG. 3. Insofar as the elements are similar, the same reference numerals as those used in FIG. 3 will also be shown in FIG. 9.

The supply bore 69 of valve 65 is connected to the pressure vessel 60. Of course, the supply line 69 could be connected to any other source of pressure, independently of the storage pressure vessel 60. The output 84 at valve 65 is connected to a control line 89 which has an outlet connected to the cylinder **72*a* formed in the valve 63 within which the piston 72 operates. The upper side of the valve element 38' of valve 65 is connected over an adjustable choke 85 to the outlet line 84. In an actual construction, the valve of FIG. 3 need be modified only by forming a narrow coaxial bore through the plug 42 and connecting the outlet of the bore from the plug with the outlet line 44, thus forming a throttled communication between the piston bore 37** and the outlet. An adjustable throttling connection can be provided by providing an additional adjustable needle in the bore.

The electrical connection lines 51', 52' connect the piezoelectric stack assembly 47', controlling position of the stem 46' to the control unit.

The control of connection line 89 is connected to the input 70 of the ON-control valve 64. Valve 64 can be identical to the valve shown in FIG. 3 and described in connection therewith, and the same reference numerals have been used, with double prime notation. The output 94 of the valve 64 is connected to the return line 95 and hence to the tank 61. Valve 64 has a piezoelectrically operating stack 47'' with a clamping stem 46' which can lock the valve element 38'' in closed condition. The stem 46' of valve 65 likewise can lock the stem 38' in closed position. The piezoelectric stack 47'' is connected to the electronic control unit 66 by electrical lines 51'', 52''.

Operation, with reference to FIGS. 9 and 10–12: Let it be assumed that, in the operating condition, the pressure in the control line 89 is $P_s$ at time $t_0$, that is, in advance of operation—see FIG. 12. The pressure $P_s$ is, for example, about 200 bar. The valve elements 38' of valve 65 and 38'' of valve 64 are clamped in their closed position—see curves $S_{64}$ and $S_{65}$, FIG. 11. They are so clamped since, as appears from FIG. 10, the control voltages $U_{64}$ and $U_{65}$ are applied to the respective piezoelectric stacks. The effective area of the control piston 72 of the fluid operated injection valve 63 is larger, and preferably substantially larger than the hydraulically effective area of the needle valve 11 in the chamber 65, and hence the valve stem 71 is securely seated on the seat 73. The injection valve is closed.

Fuel injection is to be initiated at time $t_1$, as commanded by the electronic control unit 66. The electronic control unit 66 will remove the voltage from the piezoelectric stack 47'' of valve 64—see $U_{64}$, FIG. 10. Pressure $P_s$, present in the control line 89, will lift the valve element 38'' rapidly off its seat. Since the pressure has been fully available when the clamping force due the positioning element 47'' is removed, the switching time of opening of the valve will be extremely rapid—for example in the order of about 100 microseconds. This connects the control line 89 over the return line 95 with the tank 61, and the pressure in the control line 98 drops to the value $P_0$, see FIG. 12. This removes the closing force acting on the piston 72 in cylinder **72*a* of the injection valve 63, and needle 71 can lift off its seat 73 due to the pressure in the circular chamber 75, and fuel can reach the combustion engine through the now open injection nozzle 74**.

Loss of pressure in line 89 permits the spring 41'' to return the valve element 38'' of valve 64 back on its seat. Some time thereafter, for example at time $t_2$, control unit 66 again provides a control voltage to the terminals 51'', 52'' to clamp the stem 38'' in closed position by pressure from the stem 46'' coupled to the piezoelectric stack 47''.

Fuel injection is to be terminated at time $t_3$. At this time—see FIG. 10—the electronic control unit 66 disconnects the voltage applied to terminals 51', 52' of valve 65. The pressure which acts on the inlet 69 of the valve 65, derived from the pressure storage vessel 60, will lift the valve element 38' off its seat, counter the force of spring 41'. Control pressure will thus be applied to the line 89, which will receive the control pressure $P_s$—see FIG. 12. Due to the positioning force acting on the piston 72, as pressure rises in line 89, and due to the much larger area of the piston 72 than the valve tip 11 of the valve stem 71, valve stem 71 is rapidly pressed down against its seat 73. This terminates fuel injection, and the fuel injection time period $t_1$ to $t_3$ is over.

The choke or throttle 85 provides for pressure equalization, that is, unloading the back side of the valve element 38 of the valve 65, to permit spring 41' of the valve element to close valve 65. The process can now repeat; it is to be noted that line 89 retains fluid under pressurized condition.

Various changes and modifications may be made, and features described in connection with any one of the embodiments can be used with any of the others within the scope of the inventive concept.

We claim:

1. Fuel injection system having a pump (2, 62);

an injection valve (3, 63);

hydraulic connection means (7, 67) connecting the pump and the injection valve to provide fuel from the pump to the valve, and wherein the injection valve opens to emit fuel when the pressure of applied fuel in the hydraulic connection means exceeds a predetermined opening value, and the injection valve closes when the pressure drops below a predetermined closing value;

and an electrically controlled valve arrangement, hydraulically connected to said hydraulic connection means to control the pressure therein, which comprises, in accordance with the invention, a first valve (4, 64) which controls initiation of fuel injection by selective control of the pressure in the hydraulic connection means, and a second valve (5, 65) which controls termination of injection;

each one of the first and second valves having a valve housing (16, 36) and a valve element (18, 38; 38', 38'') which is movable in predetermined direction within a bore 17, 37) of the valve housing, and hydraulically connected to said hydraulic connection means, for movement by hydraulic pressure in the connection means, acting on the movable valve element;

and an electrically controlled positioning element (27, 47; 47', 47'') having a positioning movement which has at least one component which is transverse to the moving direction of the movable valve element and which is operable between a first clamping position in which the respective positioning element clamps the respective valve element against the wall of the respective housing, and a second, released position in which the movable element releases the clamping force applied to said movable valve element to permit movement of the valve element by hydraulic pressure.

2. System according to claim 1, wherein the positioning element (27, 47; 47', 47'') comprises a stacked assembly (28) of piezoelectric disks having a stacking axis which extends at least approximately perpendicularly to said direction of movement of the movable valve element (18, 38, 38', 38'').

3. System according to claim 1 or 2, wherein (FIG. 1) a cross-connecting hydraulic line (49) is provided, in hydraulic communication with said hydraulic connection means (7) and one of said valves to permit, selectively, communication of said cross-connecting hydraulic line with said hydraulic connection means, or with a drain line (55) returning fuel to the suction side of said pump, respectively.

4. System according to claim 3, further including first spring means (21) acting on the valve element (18) of the first valve (4) and tending to hold said first valve in open position, the hydraulic pressure acting on said valve element and closing the valve element when the electrically controlled positioning element (27) releases the valve element (18) from its open position.

5. System according to claim 4, wherein the valve element (18) of said first valve (4) comprises a projecting, mushroom-like conical end portion fitting against a conically converging sealing surface (20), the first spring (21) tending to move the valve element (18), and hence the conical end portion which forms a seating surface (19) with said sealing surface (20) off the sealing surface, the electrically controlled positioning element clamping the valve element (18) in the lifted-off position.

6. System according to claim 5, wherein the gap between the conically converging sealing surface (20) and the conical end portion (19) of the valve element, when in open position, is small to form a hydraulic choke or throttle, pressure build-up in the cross-connecting line at said throttle tending to close the valve (4) by pressure acting on said conical end portion.

7. System according to claim 3, wherein the second valve (5) comprises a second spring (41) acting on the second valve element (38), and a valve seat (39) is provided, in hydraulic communication with said cross connection line, the electrically controlled positioning element (47) clamping the valve in closed position, and, upon release of clamping movement, permitting opening of the valve member hydraulic pressure in said hydraulic connection means and said cross connection hydraulic line (49).

8. System according to claim 1 or 2, wherein (FIG. 9) the injection valve (63) includes a hydraulic operating line;

a movable valve element (71) and a piston (72) secured thereto, and movable by hydraulic pressure in said hydraulic operating line;

a control hydraulic connection line (89) is provided, interconnecting said first and second valves, and being hydraulically connected to said hydraulic operating line in communication with the injection valve (63);

the first and second valves, selectively, connecting the control hydraulic connection line, and hence the hydraulic operating line to the valve (63), selectively, to the hydraulic connection means (67) or to the suction side (95) of the pump (62).

9. System according to claim 8, further comprising a pressure vessel (60) connected to the pump and providing a continuous hydraulic pressure within the hydraulic connection means.

10. System according to claim 8, wherein each of the valves (38', 38'') include a spring (41', 41'') tending to move the respective valve element (38', 38'') to a closed position;

and the electrically controlled positioning element clamps the valves in closed position, release of clamping force permitting lifting of the respective valve element under hydraulic pressure acting on the respective movable valve element.

11. System according to claim 10, wherein the movable valve element (38') of the second valve (65) comprises an elongated stem or needle having a valve seat at one end and a back portion on the other;

and a cross connection is provided to the back portion, including a hydraulic choke (85) or balance the pressure acting on the valve, under static condition.

12. System according to claim 3, wherein the pump is a piston pump.

13. System according to claim 9, wherein the pump is a continuously operating pump.

14. System according to claim 1, wherein the injection valve (3, 63) includes a valve stem (11, 71);

and force means (12, 72, 72*a*) acting on said valve stem tending to hold the valve stem in closed position unless the hydraulic pressure within the hydraulic connection means exceeds said predetermined opening value to lift the valve stem against the externally applied force.

* * * * *